US007639192B2

(12) United States Patent
Tsai et al.

(10) Patent No.: US 7,639,192 B2
(45) Date of Patent: Dec. 29, 2009

(54) ANTENNA STRUCTURE

(75) Inventors: Feng-Chi Eddie Tsai, Taipei Hsien (TW); Yu-Chuan Su, Taipei Hsien (TW); Yuan-Li Chang, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 122 days.

(21) Appl. No.: 12/018,803

(22) Filed: Jan. 24, 2008

(65) Prior Publication Data

US 2009/0121941 A1 May 14, 2009

(30) Foreign Application Priority Data

Nov. 14, 2007 (TW) ..... 96142995 A

(51) Int. Cl.
*H01Q 1/24* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS

| | | | | |
|---|---|---|---|---|
| 6,573,876 | B1 * | 6/2003 | Maroko et al. | 343/906 |
| 6,911,944 | B2 * | 6/2005 | Sekine et al. | 343/702 |
| 7,123,203 | B2 * | 10/2006 | Le Geoff et al. | 343/725 |
| 2007/0200777 | A1 * | 8/2007 | Chen et al. | 343/702 |
| 2008/0042918 | A1 * | 2/2008 | Lee | 343/848 |

* cited by examiner

*Primary Examiner*—HoangAnh T Le
(74) *Attorney, Agent, or Firm*—Winston Hsu

(57) ABSTRACT

An antenna structure includes a radiation element, a grounding element, a feeding point, and a connection element. The radiation element includes a first radiator and a second radiator. The second radiator includes a first end close to a first end of the first radiator. The grounding element is coupled to the first end of the second radiator. The feeding point is coupled to the first end of the first radiator and is close to the first end of the second radiator. The connection element is coupled between the feeding point and the grounding element. The radiation element, the grounding element, the feeding point, and the connection element are constructed by metal wire.

20 Claims, 18 Drawing Sheets

16A

16B

ANTENNA STRUCTURE

BACKGROUND OF THE INVENTION

1. Field of the Invention

The present invention relates to an antenna structure, and more particularly, to an antenna structure constructed by metal wire.

2. Description of the Prior Art

As wireless telecommunication develops with the trend of micro-sized mobile communication products, the location and the space available for implementing antennas is becoming increasingly limited. Therefore, some built-in micro antennas have been developed. Currently, some micro antennas such as a chip antenna, a planar antenna and so on are commonly used. All these antennas have the feature of occupying small volume. Additionally, planar antennas have also been designed in many forms such as micro-strip antennas, printed antennas and planar inverted F antennas. These antennas are widespread, being applied to GSM, DCS, UMTS, WLAN, Bluetooth, etc.

Thus a variety of reformed antennas and wireless communication products appear for various market requirements. Reducing the size of the antennas, improving antenna efficiency, and improving impedance matching become important topics of the field.

SUMMARY OF THE INVENTION

It is one of the objectives of the present invention to provide an antenna structure constructed by metal wire to solve the abovementioned problems.

The present invention provides an antenna structure. The antenna includes a radiation element, a grounding element, a feeding point, and a connection element. The radiation element includes a first radiator and a second radiator. The second radiator has a first end close to a first end of the first radiator. The grounding element is coupled to the first end of the second radiator. The feeding point is coupled to the first end of the first radiator and is close to the first end of the second radiator. The connection element is coupled between the feeding point and the grounding element, wherein the radiation element, the grounding element, the feeding point, and the connection element are constructed by metal wire.

In one embodiment, the antenna structure further includes a fixing element. The fixing element is coupled to the grounding element for fixing the antenna structure on a substrate.

In one embodiment, the first radiator and the second radiator extend to different directions. A length of the first radiator is approximately one-fourth of a wavelength of a first resonance mode generated by the antenna structure, and a length of the second radiator is approximately one-fourth of a wavelength of a second resonance mode generated by the antenna structure.

In one embodiment, the first radiator and the second radiator extend to an identical direction. A length of the first radiator is approximately one-fourth of a wavelength of a first resonance mode generated by the antenna structure, and an overlapping portion of the first radiator and the second radiator is used for resonating a second resonance mode of the antenna structure.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
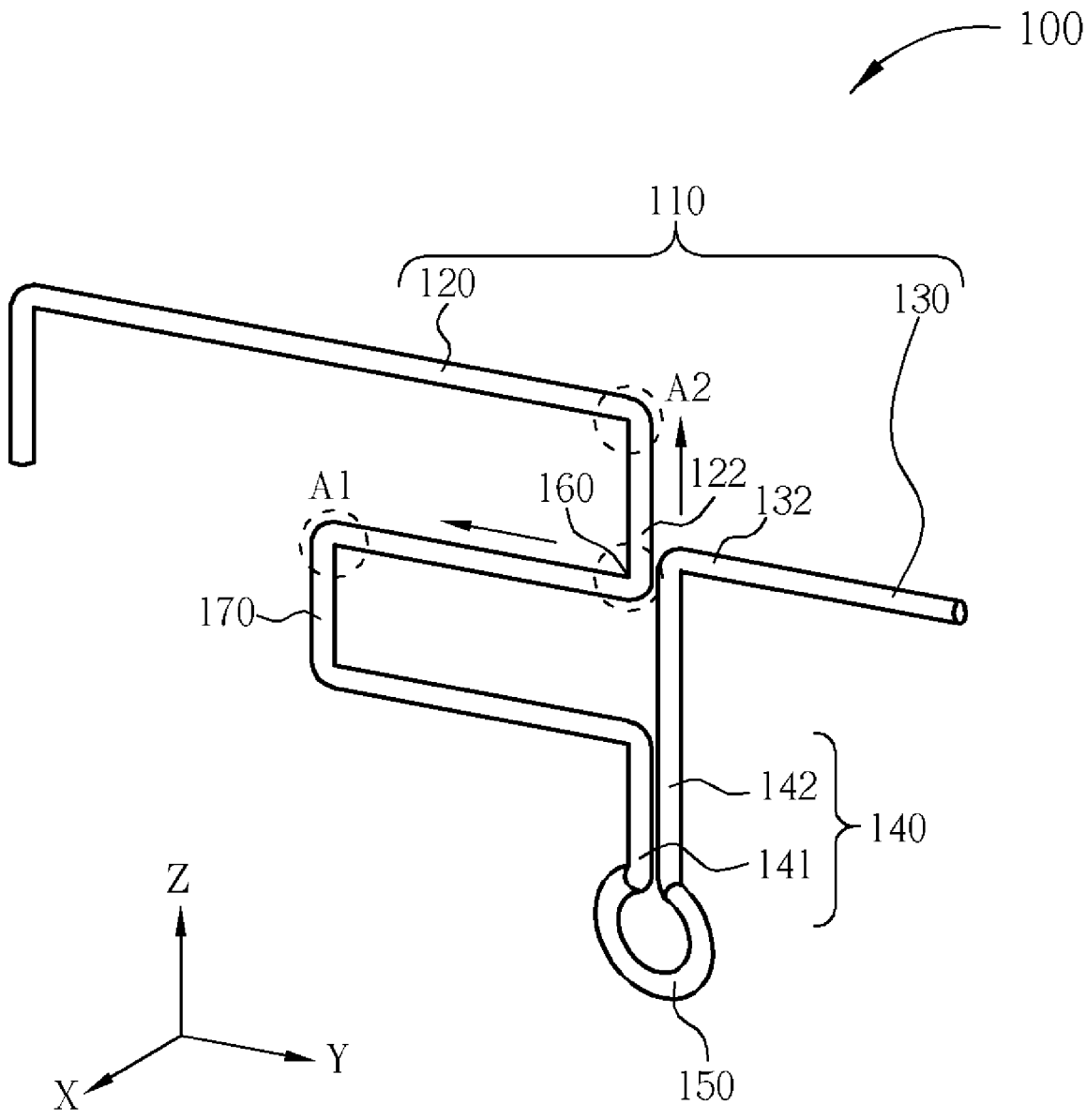
FIG. 1 is a diagram of an antenna structure according to a first embodiment of the present invention.

Please refer to FIG. 1. FIG. 1 is an antenna structure according to a first embodiment of the present invention. As shown in FIG. 1, the antenna structure 100 includes a radiation element 110, a grounding element 140, a fixing element 150, a feeding point 160, and a connection element 170. The radiation element 110 includes a first radiator 120 and a second radiator 130. The first radiator 120 has a first end 122 and the second radiator 130 has a first end 132 close to the first end 122 of the first radiator 120. The grounding element 140 is coupled between the first end 132 of the second radiator 130 and the fixing element 150. The feeding point 160 is coupled to the first end 122 of the first radiator 120 and is close to the first end 132 of the second radiator 130. The connection element 170 is coupled between the feeding point 160 and the grounding element 140 for matching the impedance of the antenna structure 100. The fixing element 150 is coupled to the grounding element 140 for fixing the antenna structure 100 on a substrate (not shown). Please note that the radiation element 110, the grounding element 140, the feeding point 160, the fixing element 150, and the connection element 170 are constructed by metal wire, such as a copper wire. The type of metal wire should not be a limitation of the present invention.

Please keep referring to FIG. 1. The abovementioned grounding element 140 includes a first section 141 and a second section 142, which are together coupled to a grounding end (not shown) by solder. In addition, the position of the feeding point 160 can be variable, and it can be moved to any position between positions A1-A2 according to the direction indicated by the arrow in FIG. 1. In this embodiment, the fixing element 150 is a circle, but this should not be a limitation: it can be a polygon or other shapes. The fixing element 150 is used for fixing the antenna structure 100 on a substrate (not shown), such as a grounding plane. For example, the fixing element 150 fixes the antenna structure 100 on the substrate by locking screws.

Please note that in this embodiment, the first radiator 120 and the second radiator 130 are not close to each other and extend in different directions. The first radiator 120 is used for resonating at an operating frequency band with a lower frequency, such as 2.4 GHz-2.5 GHz. A length of the first radiator 120 is approximately one-fourth of a wavelength ($\lambda/4$) of a first resonance mode generated by the antenna structure 100. The second radiator 130 is used for resonating at an operating frequency band with a higher frequency, such as 4.9 GHz-5.85 GHz. A length of the second radiator 130 is approximately one-fourth of a wavelength of a second resonance mode generated by the antenna structure 100. In this embodiment, the antenna structure 100 is a dual-band antenna and is disposed inside a housing of a wireless communication apparatus, such as a portable device or an ultra-mobile personal computer (UMPC), but it is not limited to this only and can be applied to wireless communication apparatus of other types.

Of course, the antenna structure 100 shown in FIG. 1 is merely an embodiment of the present invention. Those skilled in the art should appreciate that various modifications of the antenna structure 100 may be made. In the following, some embodiments are presented for describing various modifications of the antenna structure 100.

Figure 2:
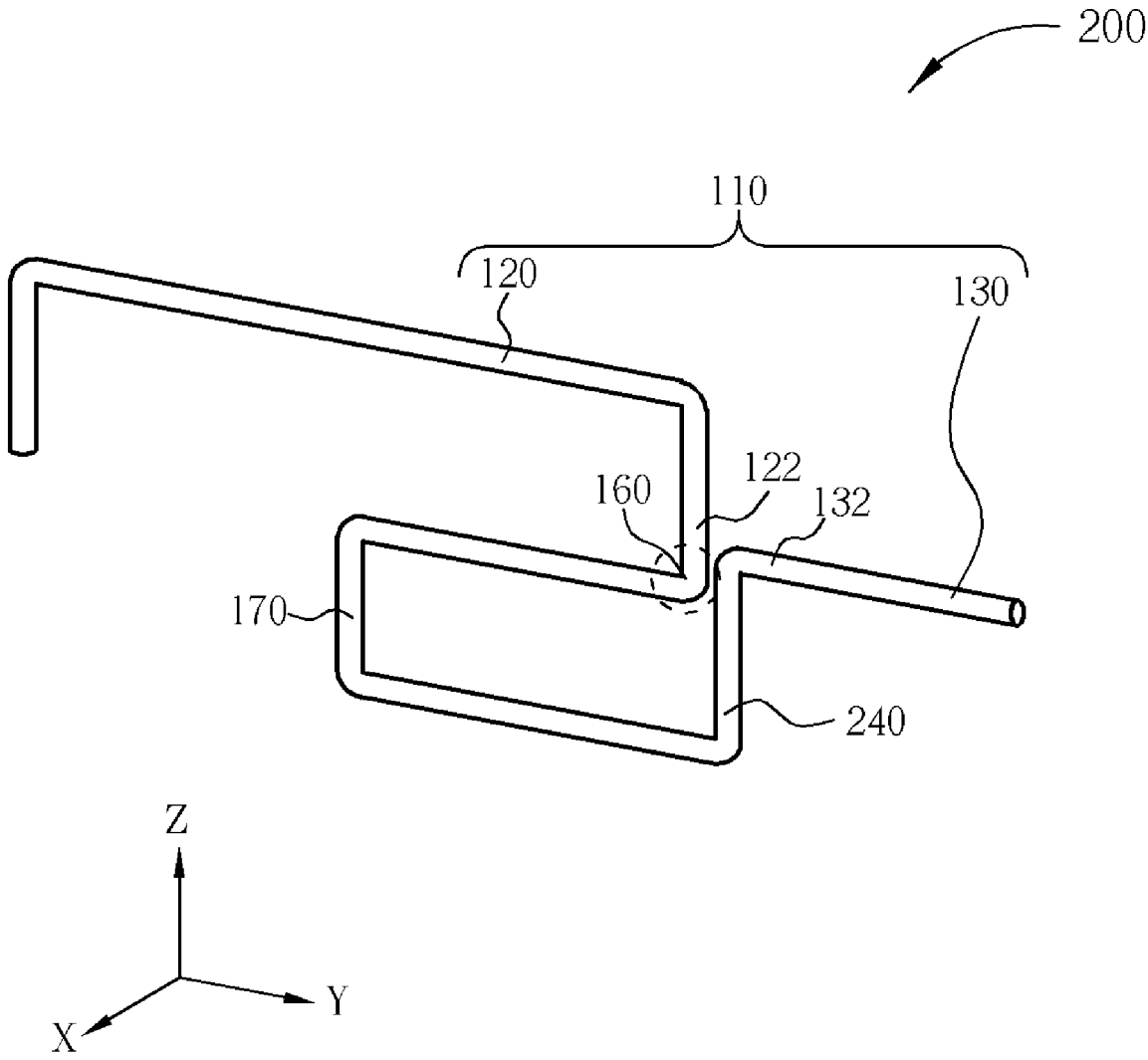
FIG. 2 is a diagram of an antenna structure according to a second embodiment of the present invention.

Please refer to FIG. 2. FIG. 2 is a diagram of an antenna structure according to a second embodiment of the present invention, which is a varied embodiment of the antenna structure 100 shown in FIG. 1. The architecture of the antenna structure 200 in FIG. 2 is similar to the antenna structure 100 shown in FIG. 1. The difference between them is that the antenna structure 200 omits the fixing element 150 and only one section, even one joint, is used for representing a grounding element 240 of the antenna structure 200.

Figure 3:
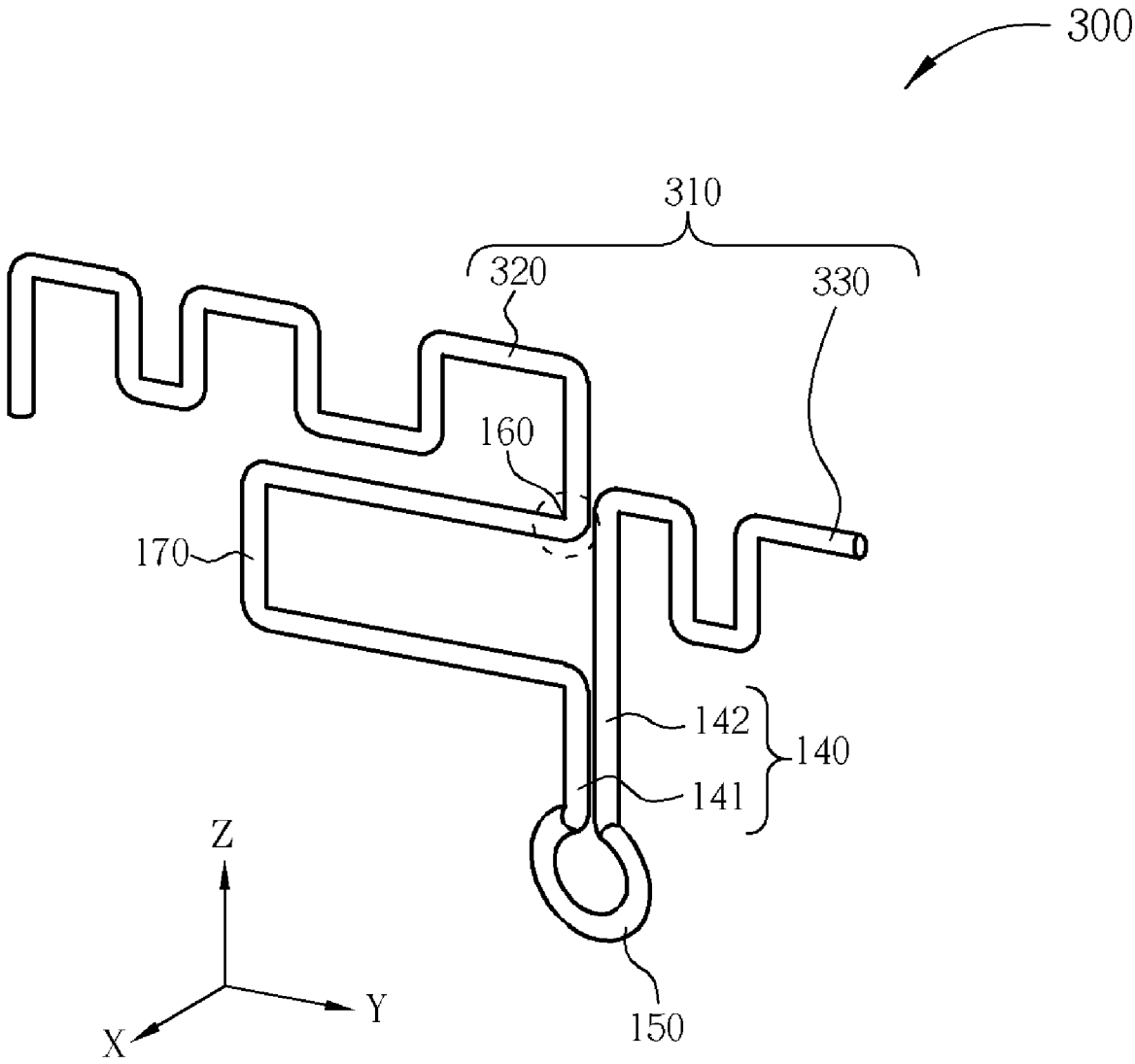
FIG. 3 is a diagram of an antenna structure according to a third embodiment of the present invention.

Please refer to FIG. 3. FIG. 3 is a diagram of an antenna structure according to a third embodiment of the present invention, which is a varied embodiment of the antenna structure 100 shown in FIG. 1. The architecture of the antenna structure 300 in FIG. 3 is similar to the antenna structure 100 shown in FIG. 1. Please note that the difference between them is that a first radiator 320 and a second radiator 330 included by a radiation element 310 of the antenna structure 300 each has at least one bend.

Figure 4:
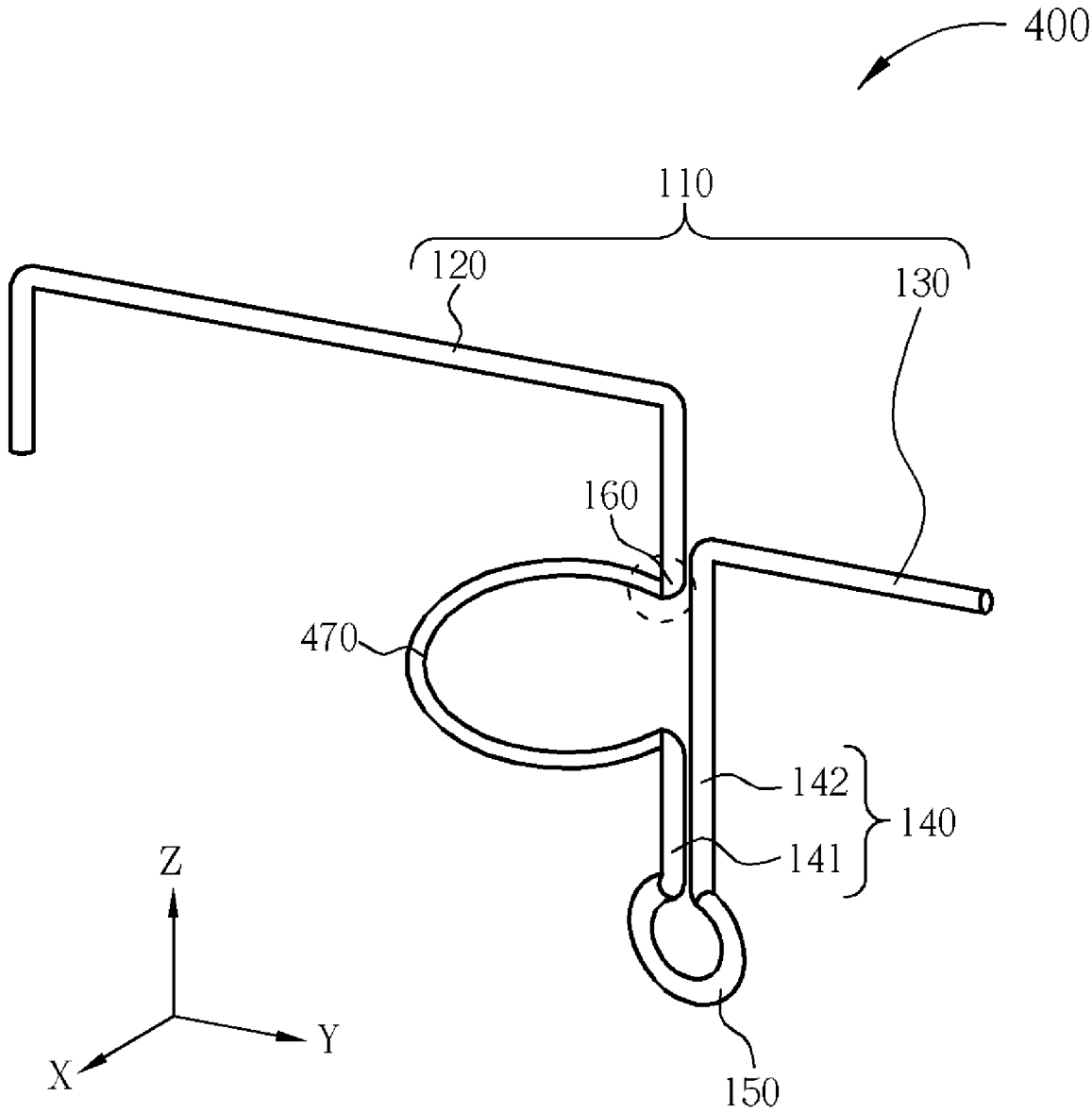
FIG. 4 is a diagram of an antenna structure according to a fourth embodiment of the present invention.

Please refer to FIG. 4. FIG. 4 is a diagram of an antenna structure according to a fourth embodiment of the present invention, which is a varied embodiment of the antenna structure 100 shown in FIG. 1. The architecture of the antenna structure 400 in FIG. 4 is similar to the antenna structure 100 shown in FIG. 1. The difference between them is that a connection element 470 of the antenna structure 400 is a circle, but this should not be a limitation of the present invention. Those skilled in the art should appreciate that various modifications of shapes and angles of the connection element 470 may be made. Please note that the connection element 470 includes a fixed length to match the impedance of the antenna structure 400.

Figure 5:
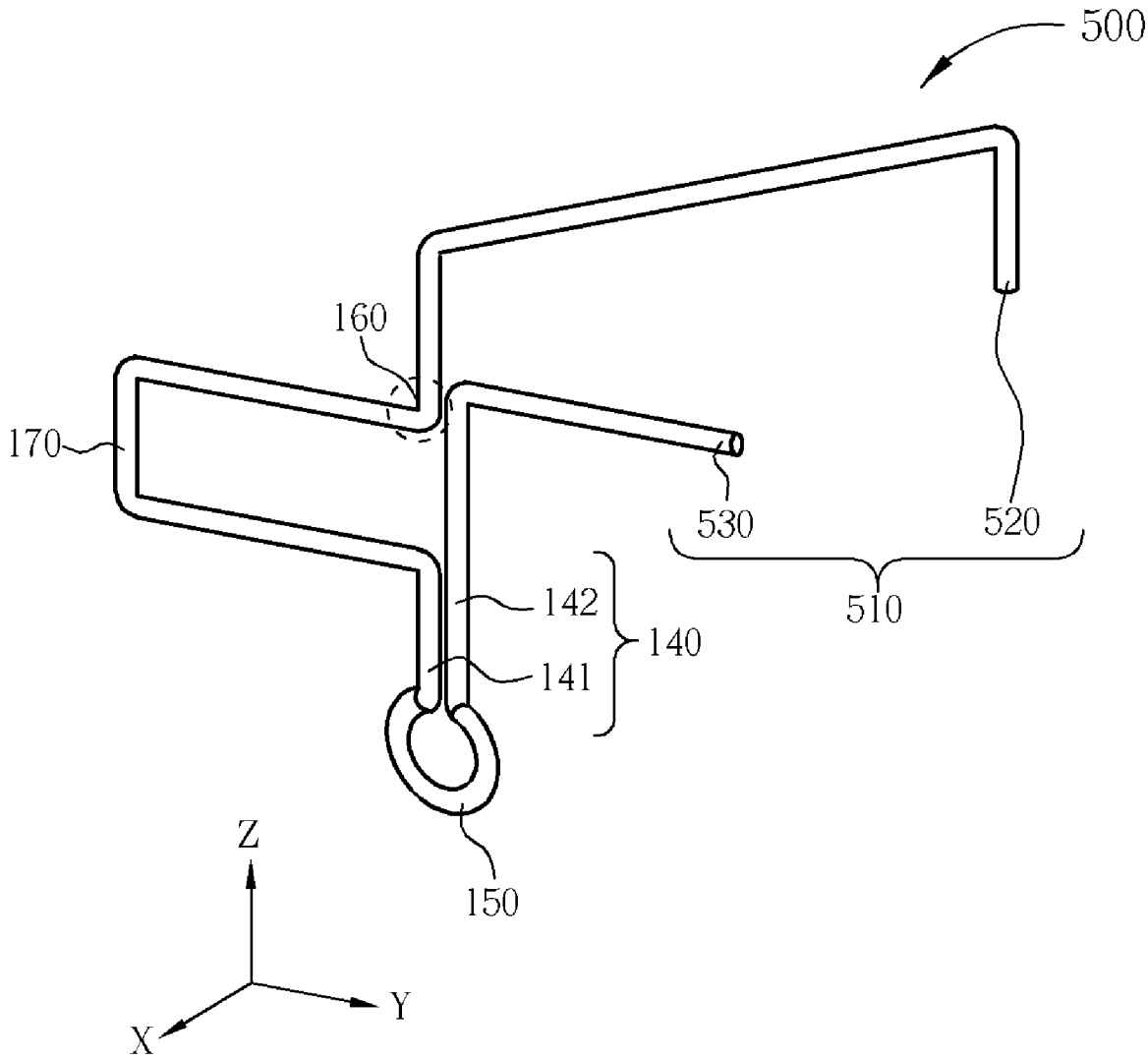
FIG. 5 is a diagram of an antenna structure according to a fifth embodiment of the present invention.

Please refer to FIG. 5. FIG. 5 is a diagram of an antenna structure according to a fifth embodiment of the present invention, which is a varied embodiment of the antenna structure 100 shown in FIG. 1. The architecture of the antenna structure 500 in FIG. 5 is similar to the antenna structure 100 shown in FIG. 1. The difference between them is that extending directions that a first radiator 520 and a second radiator 530 of the antenna structure 500 extend are different from extending directions that the first radiator 120 and the second radiator 130 of the antenna structure 100 extend. As shown in FIG. 1, the first radiator 120 extends along the −Y axis and the second radiator 130 extends along the +Y axis. As shown in FIG. 5, the first radiator 520 extends along the −X axis and the second radiator 530 extends along the +Y axis. However, this is merely an example for illustrating features of the present invention and should not be a limitation of the present invention. For example, the first radiator and the second radiator can respectively extend along other planes or other directions.

Those skilled in the art should appreciate that various modifications of the antenna structures in FIG. 1-FIG. 5 may be made without departing from the spirit of the present invention. For example, the antenna structures in FIG. 1-FIG. 5 can be arranged or combined randomly into a new varied embodiment. The abovementioned embodiments are presented merely for illustrating practicable designs of the present invention, and should not be limitations of the present invention. Furthermore, the number of the bends is not limited.

Figure 6:
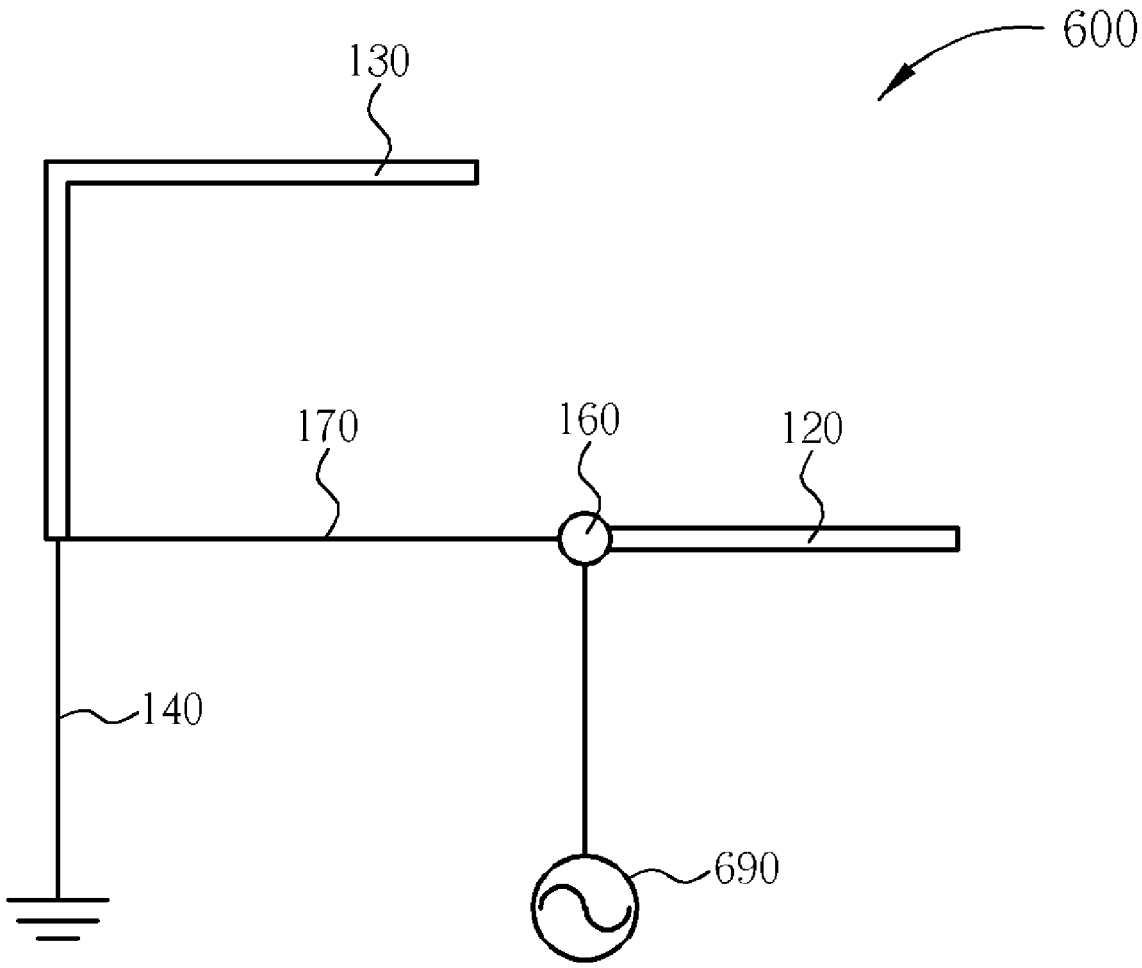
FIG. 6 is a diagram illustrating an equivalent circuit of the antenna structure shown in FIG. 1.

Please refer to FIG. 6. FIG. 6 is a diagram illustrating an equivalent circuit 600 of the antenna structure 100 shown in FIG. 1. As shown in FIG. 6, identical elements are represented by the same symbols. For example, the first radiator 120 is coupled to the feeding point 160 and a signal source 690, and the connection element 170 is coupled to the feeding point 160 and the grounding element 140. The second radiator 130 is coupled to the grounding element 140. Similarly, the antenna structures mentioned in FIG. 2-FIG. 5 can also be represented by the equivalent circuit 600.

Figure 7:
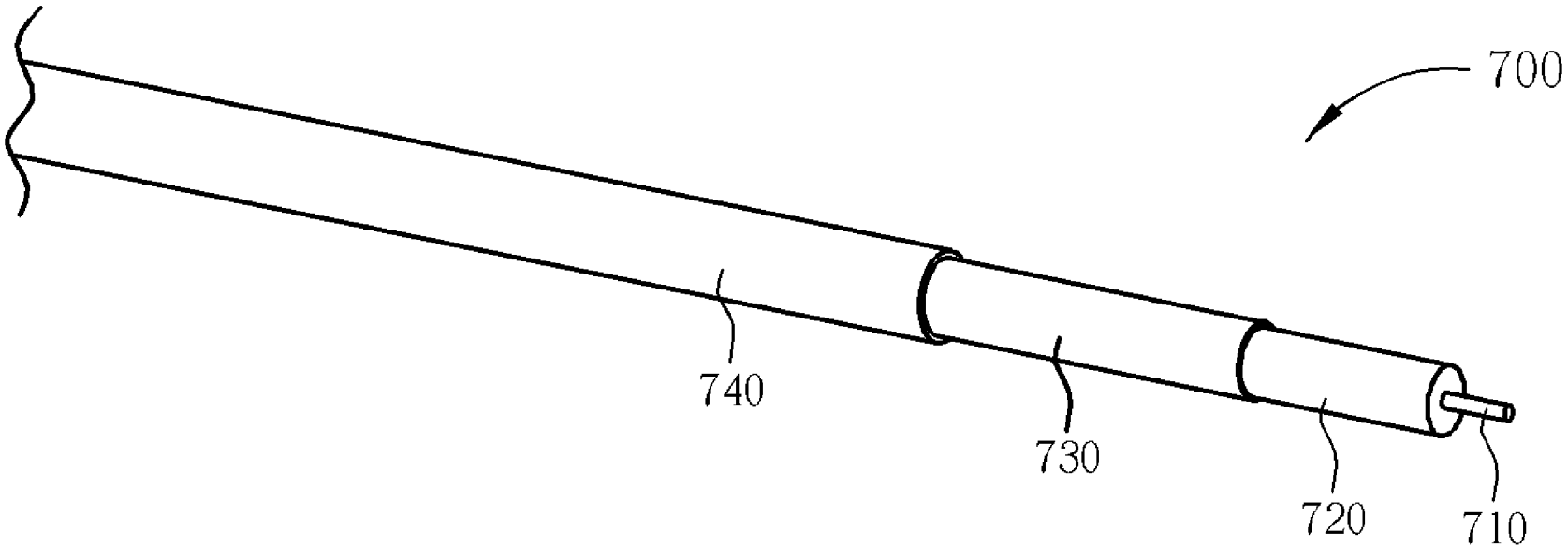
FIG. 7 is a simplified diagram of a coaxial cable.

Please refer to FIG. 7. FIG. 7 is a simplified diagram of a coaxial cable 700. The coaxial cable 700 includes a first conductor layer 710, a first isolation layer 720, a second conductor layer 730, and a second isolation layer 740. The first isolation layer 720 covers the first conductor layer 710 and lies in between the first conductor layer 710 and the second conductor layer 730, the second isolation layer 740 covers the second conductor layer 730. The first conductor layer 730 is coupled to the feeding point 160 of the antenna structure 100 shown in FIG. 1, and the second conductor layer 730 is coupled to the grounding element 140 of the antenna structure 100. The abovementioned first isolation layer 720 is composed of nonconductor materials, such as Teflon. The second isolation layer 740 is composed of nonconductor materials, such as plastics, but this is not a limitation of the present invention.

In other embodiments, a first electric wire can be utilized for replacing the first conductor layer 710 of the coaxial cable 700, which is coupled to the feeding point 160 of the antenna structure 100. A second electric wire can be utilized for replacing the second conductor layer 730 of the coaxial cable 700, which is coupled to the grounding element 140 of the antenna structure 100.

Figure 8:
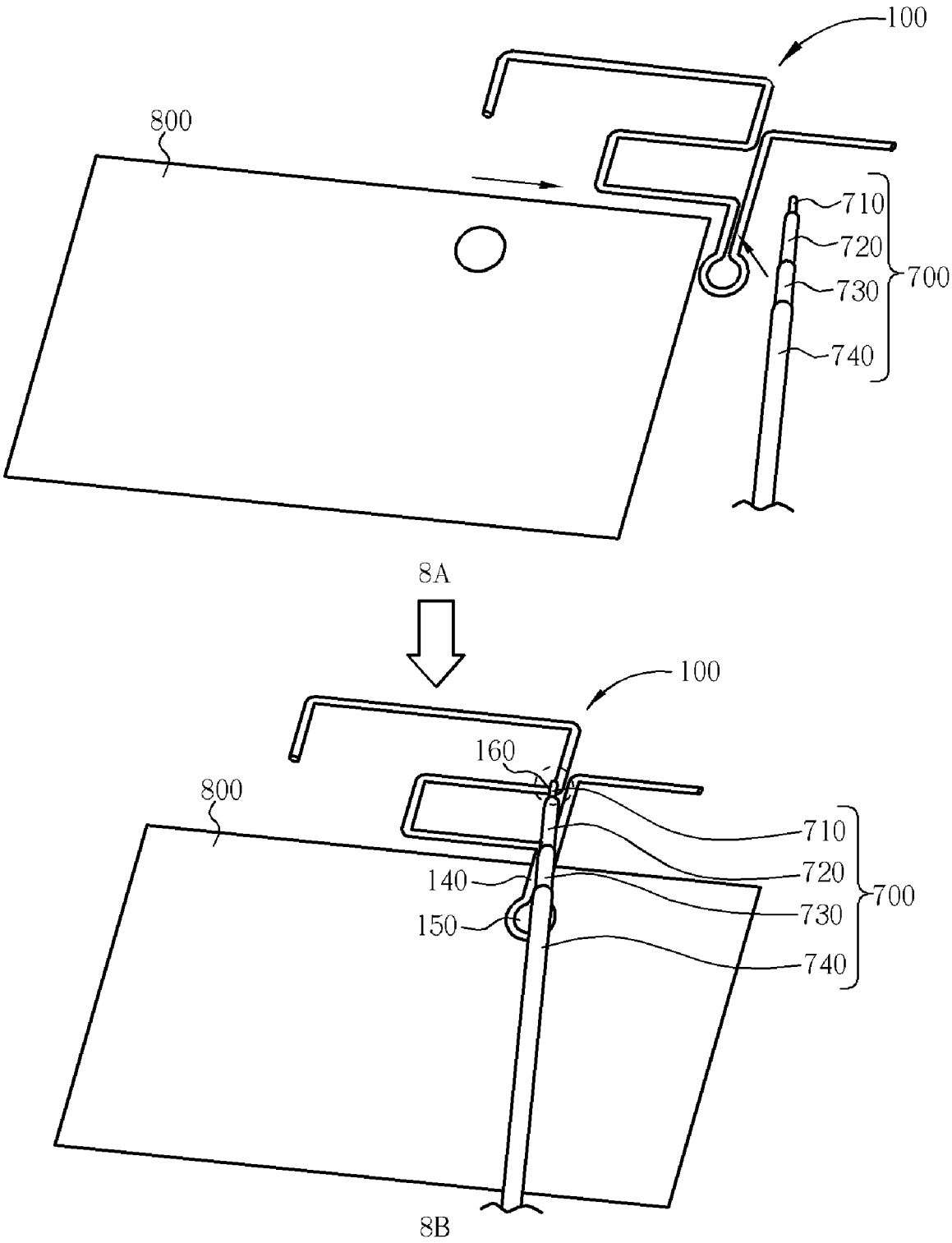
FIG. 8 is a diagram illustrating how to fabricate the antenna structure shown in FIG. 1, the coaxial cable shown in FIG. 7, and a grounding plane.

Please refer to FIG. 8. FIG. 8 is a diagram illustrating how to fabricate the antenna structure 100 shown in FIG. 1, the coaxial cable 700 shown in FIG. 7, and a grounding plane 800. As shown in 8A, the antenna structure 100, the coaxial cable 700, the grounding plane 800, and the elements included are marked respectively. As shown in 8B, the fixing element 150 of the antenna structure 100 is fixed on the grounding plane 800 by locking screws. The feeding point 160 of the antenna structure 100 is coupled to the first conductor layer 710 of the coaxial cable 700 in a soldering manner, and the grounding element 140 is coupled to the second conductor layer 730 of the coaxial cable 700 in a soldering manner, too. By fabricating the antenna structure 100 and the grounding plane 800, the grounding effect can be improved.

Figure 9:
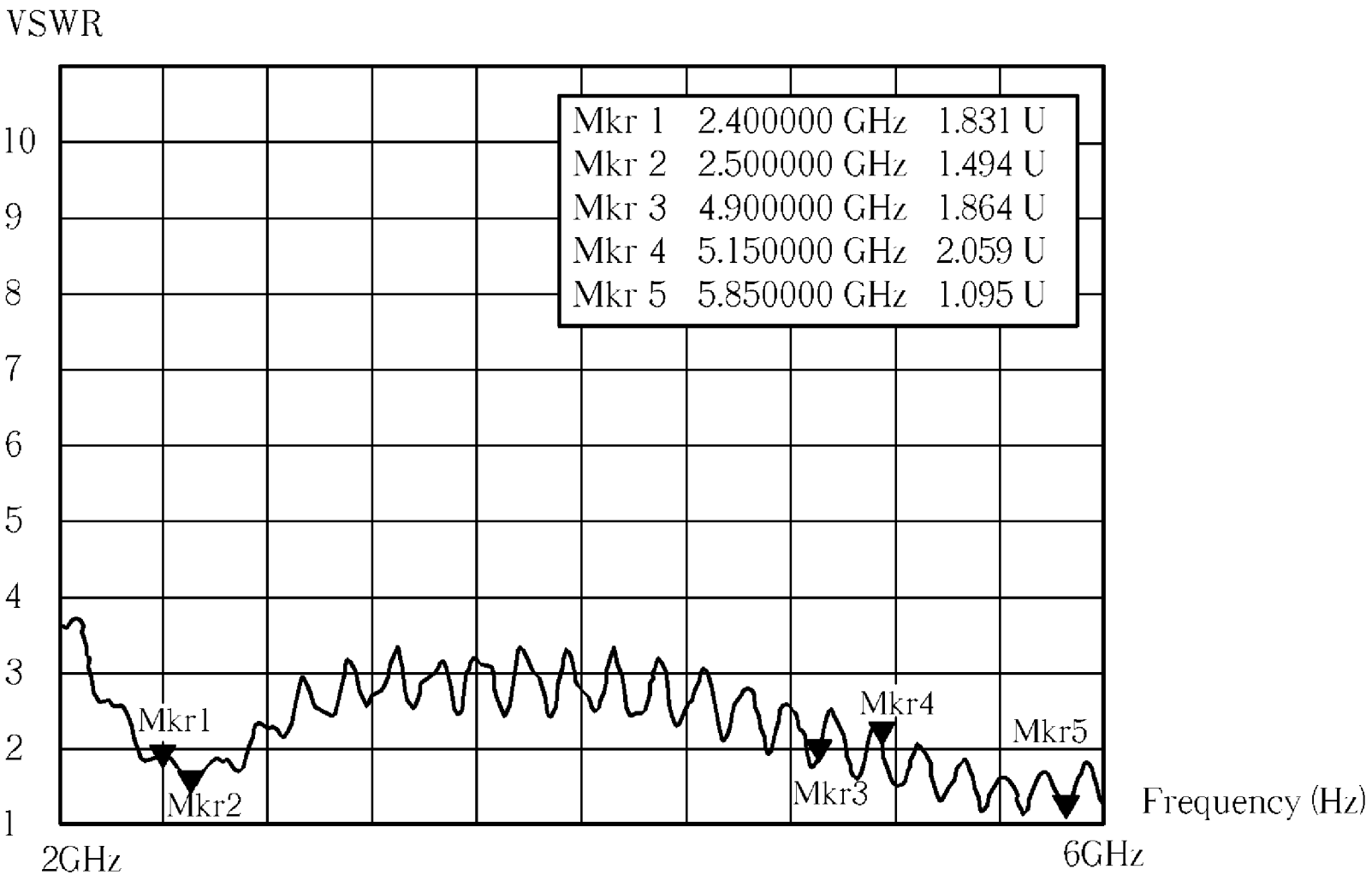
FIG. 9 is a diagram illustrating the VSWR of the antenna structure shown in FIG. 1.

Please refer to FIG. 9. FIG. 9 is a diagram illustrating the VSWR of the antenna structure 100 shown in FIG. 1. The horizontal axis represents frequency (Hz), between 2 GHz and 6 GGHz, and the vertical axis represents VSWR. As shown in FIG. 9, the frequencies and VSWR of five signs (Mkr 1-Mkr 5) are marked out. The first radiator 120 of the antenna structure 100 can resonate at the operating frequency band (2.4 GHz-2.5 GHz) of the first resonance mode, i.e., the signs Mkr 1 and Mkr 2 marked in FIG. 9. Furthermore, the second radiator 130 can resonate at the operating frequency band (4.9 GHz-5.85 GHz) of the second resonance mode, i.e., the signs Mkr 3, Mkr 4, and Mkr 5 marked in FIG. 9. As can be seen in FIG. 9, for frequencies adjacent to 2.4 GHz-2.5 GHz, or 4.9 GHz-5.85 GHz, the VSWR all fall below 3, which can satisfy demands of the wireless communication system.

Figure 10:
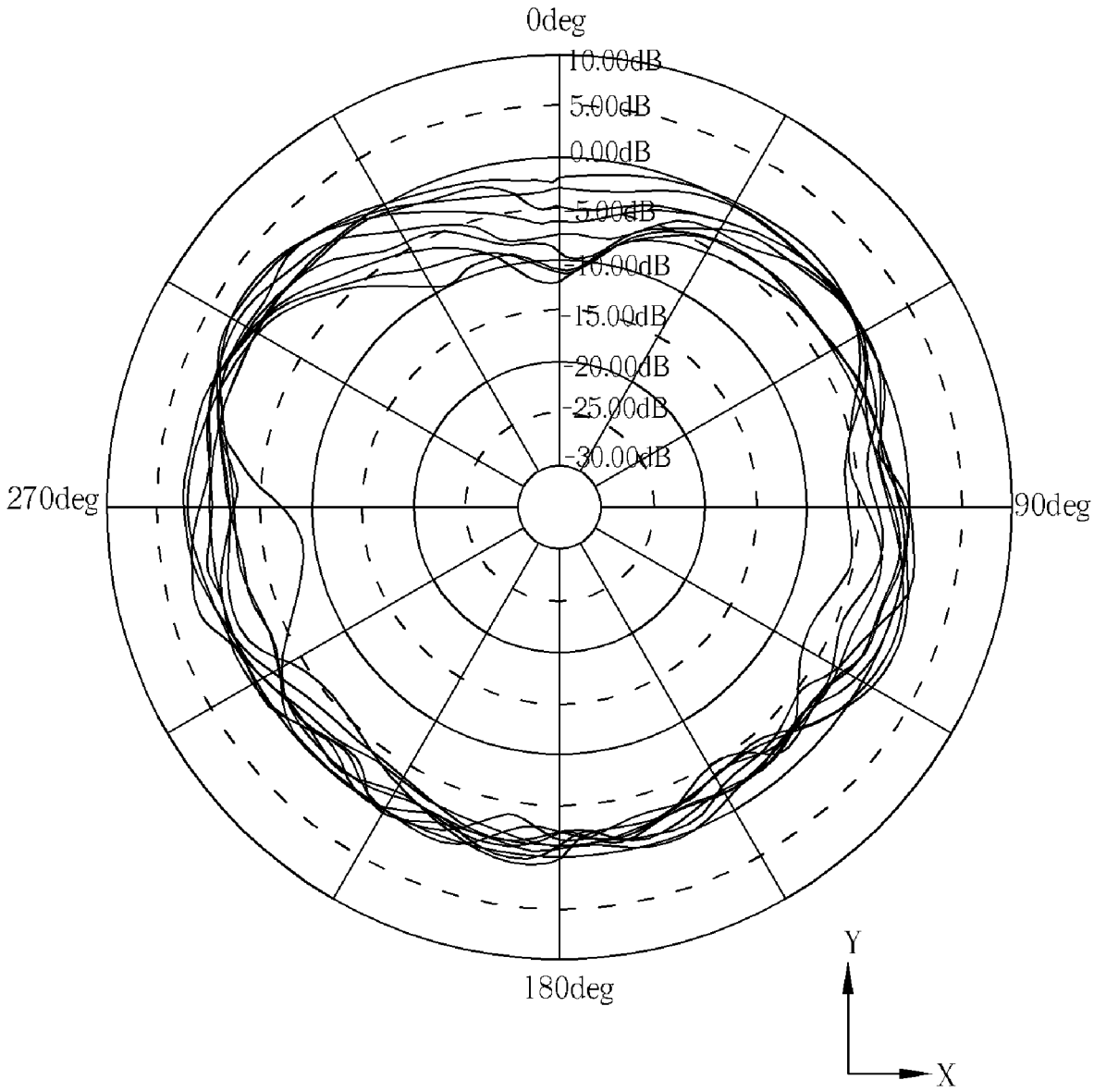
FIG. 10 is a diagram of a radiation pattern of the antenna structure shown in FIG. 1.

Please refer to FIG. 10. FIG. 10 is a diagram of a radiation pattern of the antenna structure 100 shown in FIG. 1. As shown in FIG. 10, which shows measurement results of the antenna structure 100 in XY plane, the radiation pattern of the antenna structure 100 is an omni-directional antenna.

Figure 11:
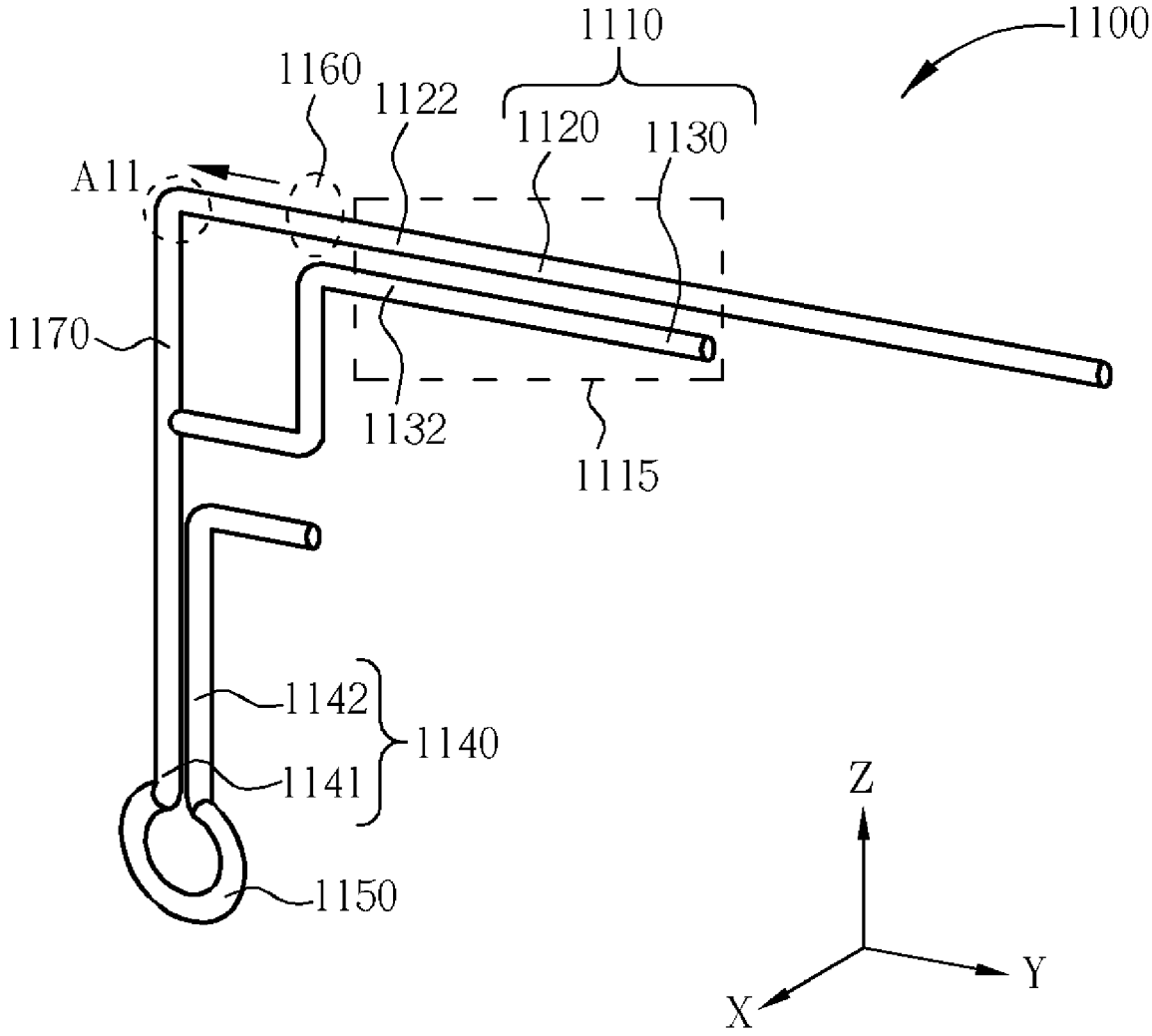
FIG. 11 is a diagram of an antenna structure according to a sixth embodiment of the present invention.

Please refer to FIG. 11. FIG. 11 is a diagram of an antenna structure according to a sixth embodiment of the present invention. As shown in FIG. 11, the antenna structure 1100 includes a radiation element 1110, a grounding element 1140, a fixing element 1150, a feeding point 1160, and a connection element 1170. The radiation element 1110 includes a first radiator 1120 and a second radiator 1130. The first radiator 1120 includes a first end 1122, and the second radiator 1130 includes a first end 1132 close to the first end 1122 of the first radiator 1120. The grounding element 1140 is coupled between the connection element 1170 and the fixing element 1150, and the feeding point 1160 is coupled to the first end 1122 of the first radiator 1120 and is close to the first end 1132 of the second radiator 1130. The connection element 1170 is coupled between the feeding point 1160 and the grounding element 1140, for matching the impedance of the antenna structure 1100. The fixing element 1150 is coupled to the grounding element 1140 for fixing the antenna structure 1100 on a substrate (not shown). Please note that the radiation element 1110, the grounding element 1140, the feeding point 1160, the fixing element 1150, and the connection element 1170 are constructed by a metal wire, such as a copper wire. But the type of the metal wire should not be a limitation of the present invention.

Please keep referring to FIG. 11. The abovementioned grounding element 1140 includes a first section 1141 and a second section 1142, which are together coupled to a grounding end (not shown) by solder. In addition, the position of the feeding point 1160 can be variable, and it can be moved to any position between the current position and the position A11 according to the direction indicated by the arrow in FIG. 11. In this embodiment, the fixing element 1150 is a circle, but this should not be a limitation and it can be a polygon or other shapes. The fixing element 1150 is used for fixing the antenna structure 1100 on a substrate (not shown), such as a grounding plane. For example, the fixing element 1150 fixes the antenna structure 1100 on the substrate by locking screws.

Please note that in this embodiment, the first radiator 1120 and the second radiator 1130 are close to each other and extend in an identical direction. The first radiator 1120 extends along the +Y axis, and the second radiator 1130 also extends along the +Y axis. The first radiator 1120 is used for resonating at an operating frequency band with a lower frequency, such as 2.4 GHz-2.5 GHz. A length of the first radiator 1120 is approximately one-fourth of a wavelength ($\lambda/4$) of a first resonance mode generated by the antenna structure 1100. An overlapping portion 1115 of the first radiator 1120 and the second radiator 1130 is used for resonating at an operating frequency band with a higher frequency, such as 4.9 GHz-5.85 GHz, which is a second resonance mode of the antenna structure 1100. In this embodiment, the antenna structure 1100 is a dual-band antenna and is disposed inside a housing of a wireless communication apparatus, such as a portable device or an ultra-mobile personal computer (UMPC), but is not limited to this only and can be applied to wireless communication apparatuses of other types.

Of course, the antenna structure 1100 shown in FIG. 11 is merely an embodiment of the present invention. Those skilled in the art should appreciate that various modifications of the antenna structure 1100 may be made. In the following, some embodiments are given for describing various modifications of the antenna structure 1100.

Figure 12:
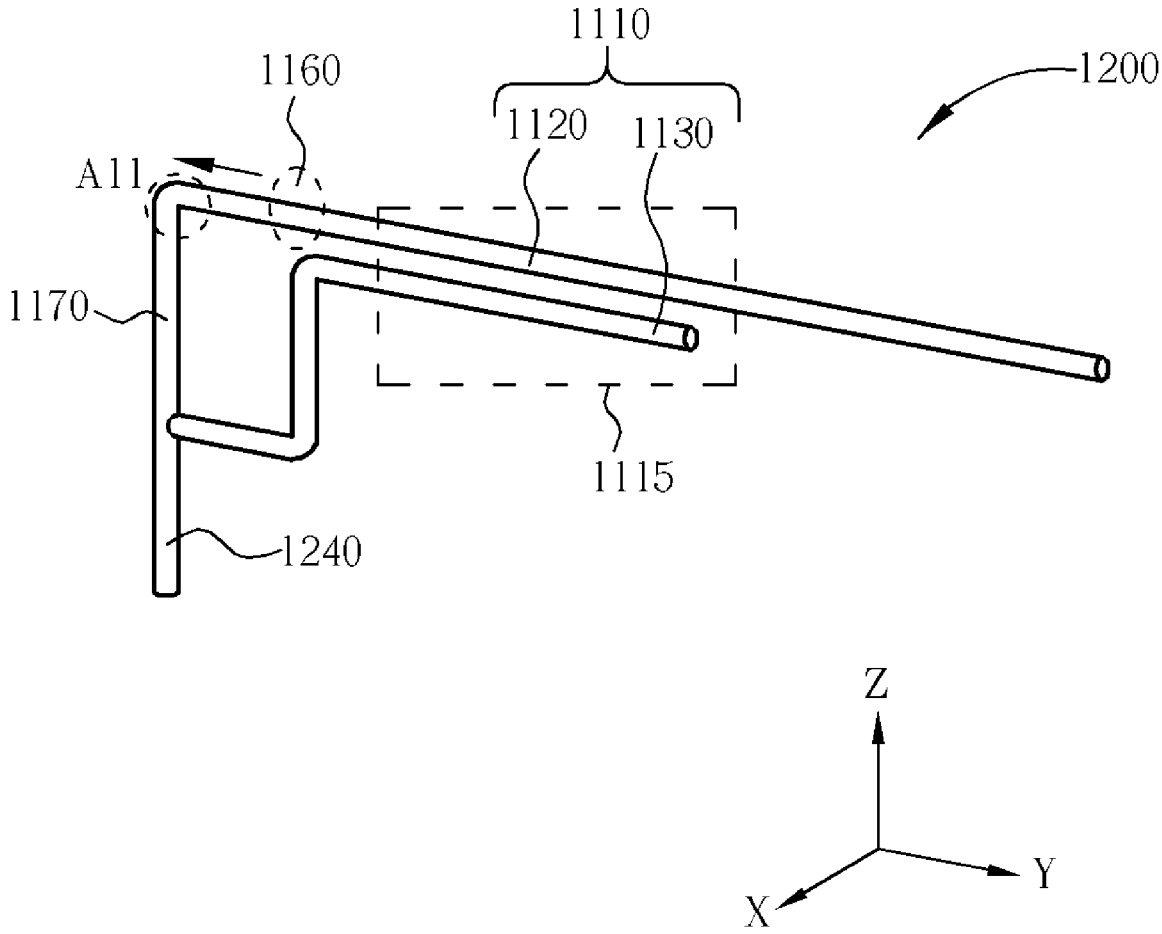
FIG. 12 is a diagram of an antenna structure according to a seventh embodiment of the present invention.

Please refer to FIG. 12. FIG. 12 is a diagram of an antenna structure according to a seventh embodiment of the present invention, which is a varied embodiment of the antenna structure 1100 shown in FIG. 11. The architecture of the antenna structure 1200 in FIG. 12 is similar to the antenna structure 1100 shown in FIG. 11. The difference between them is that the antenna structure 1200 omits the fixing element 1150 and only one section, even one joint, is used for representing a grounding element 1240 of the antenna structure 1200.

Figure 13:
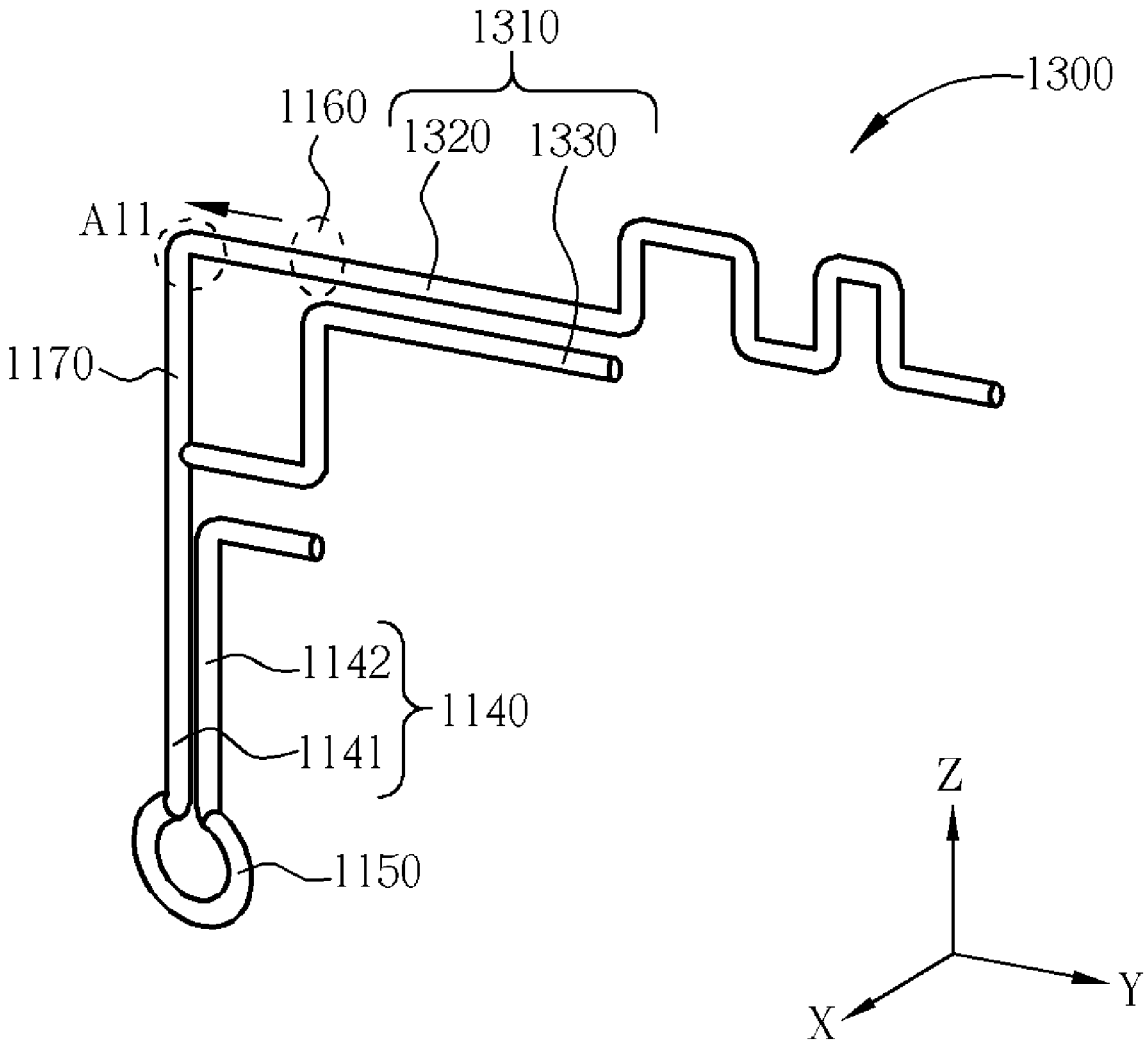
FIG. 13 is a diagram of an antenna structure according to an eighth embodiment of the present invention.

Please refer to FIG. 13. FIG. 13 is a diagram of an antenna structure according to an eighth embodiment of the present invention, which is a varied embodiment of the antenna structure 1100 shown in FIG. 11. The architecture of the antenna structure 1300 in FIG. 13 is similar to the antenna structure 1100 shown in FIG. 11. Please note that the difference between them is that a first radiator 1320 and a second radiator 1330 included by a radiation element 1310 of the antenna structure 1300 each has at least one bend.

Figure 14:
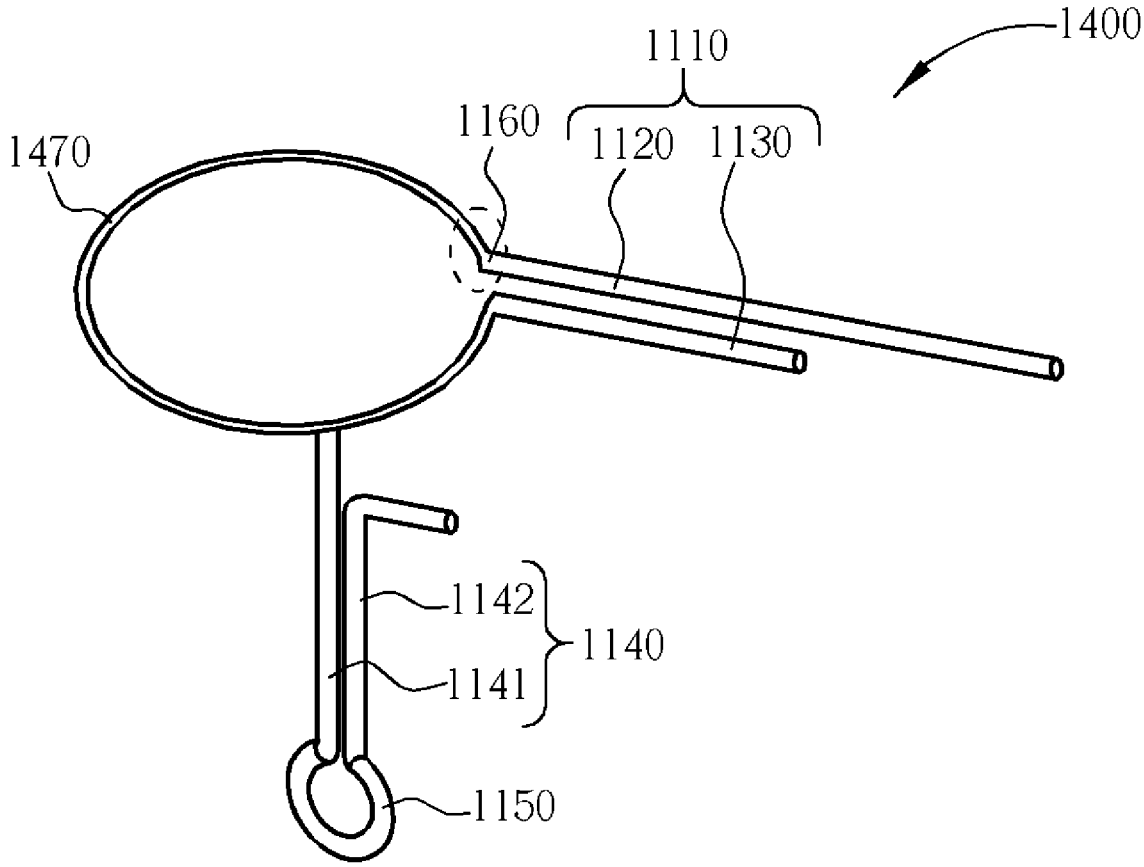
FIG. 14 is a diagram of an antenna structure according to a ninth embodiment of the present invention.

Please refer to FIG. 14. FIG. 14 is a diagram of an antenna structure according to a ninth embodiment of the present invention, which is a varied embodiment of the antenna structure 1100 shown in FIG. 11. The architecture of the antenna structure 1400 in FIG. 14 is similar to the antenna structure 1100 shown in FIG. 11. The difference between them is that a connection element 1470 of the antenna structure 1400 is a circle, but this is not a limitation of the present invention. Those skilled in the art should appreciate that various modifications of shapes and angles of the connection element 1470 may be made. Please note that the connection element 1470 includes a fixed length to match the impedance of the antenna structure 1400.

Figure 15:
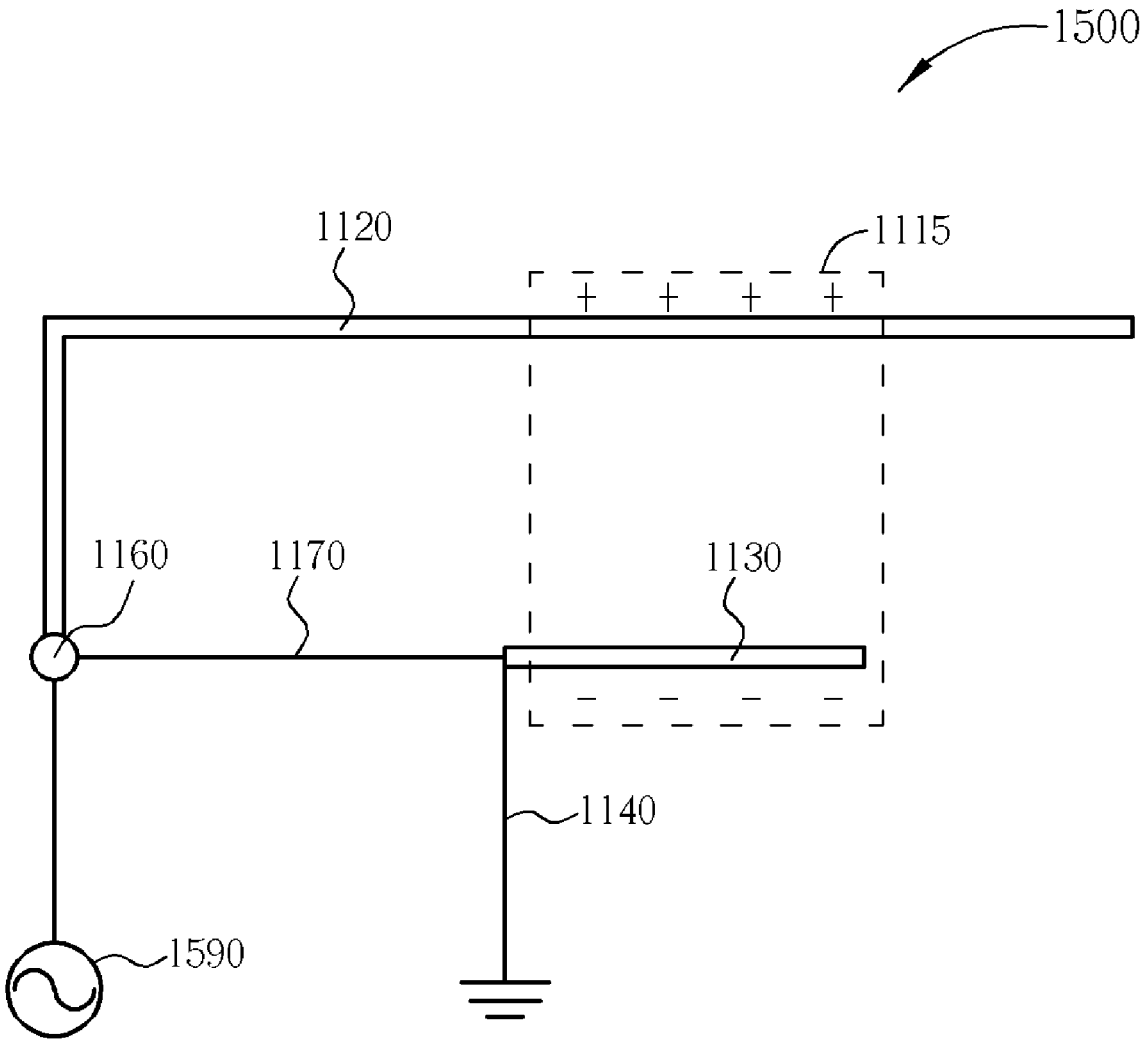
FIG. 15 is a diagram illustrating an equivalent circuit of the antenna structure shown in FIG. 11.

Please refer to FIG. 15. FIG. 15 is a diagram illustrating an equivalent circuit 1500 of the antenna structure 1100 shown in FIG. 11. As shown in FIG. 15, identical elements are represented by the same symbols. For example, the first radiator 1120 is coupled to the feeding point 1160 and coupled to a signal source 1590, and the connection element 1170 is coupled to the feeding point 1160 and the grounding element 1140. The second radiator 1130 is coupled to the grounding element 1140. The symbol 1115 represents the overlapping portion of the first radiator 1120 and the second radiator 1130.

Similarly, the antenna structures mentioned in FIG. 12-FIG. 14 can also be represented by the equivalent circuit 1500.

Figure 16:
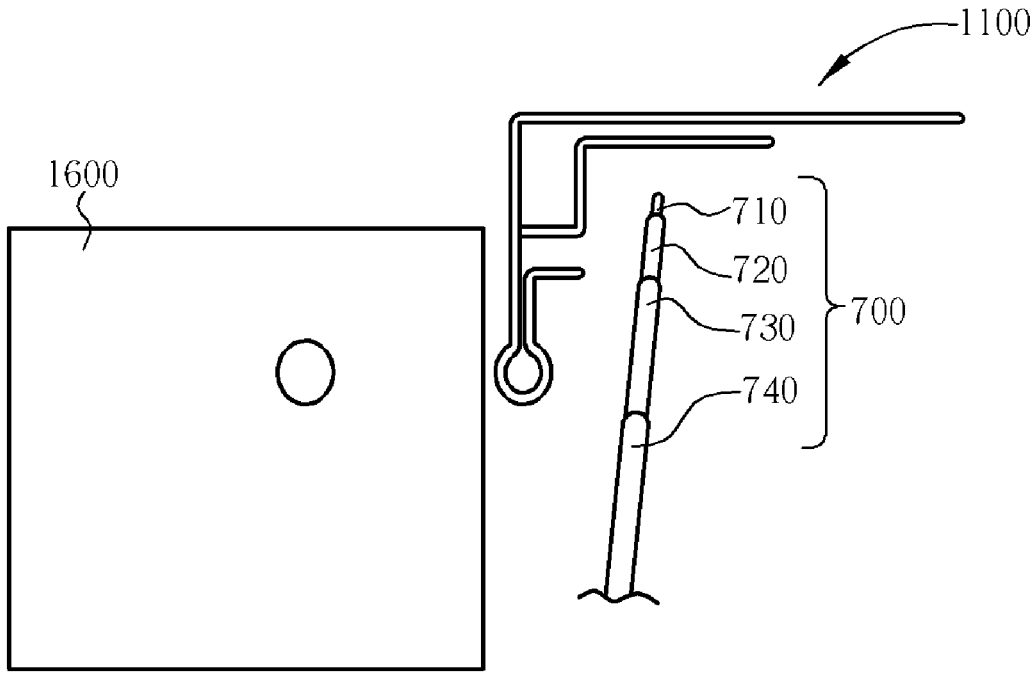
FIG. 16 is a diagram illustrating how to fabricate the antenna structure shown in FIG. 11, the coaxial cable shown in FIG. 7, and a grounding plane.
Figure 16:
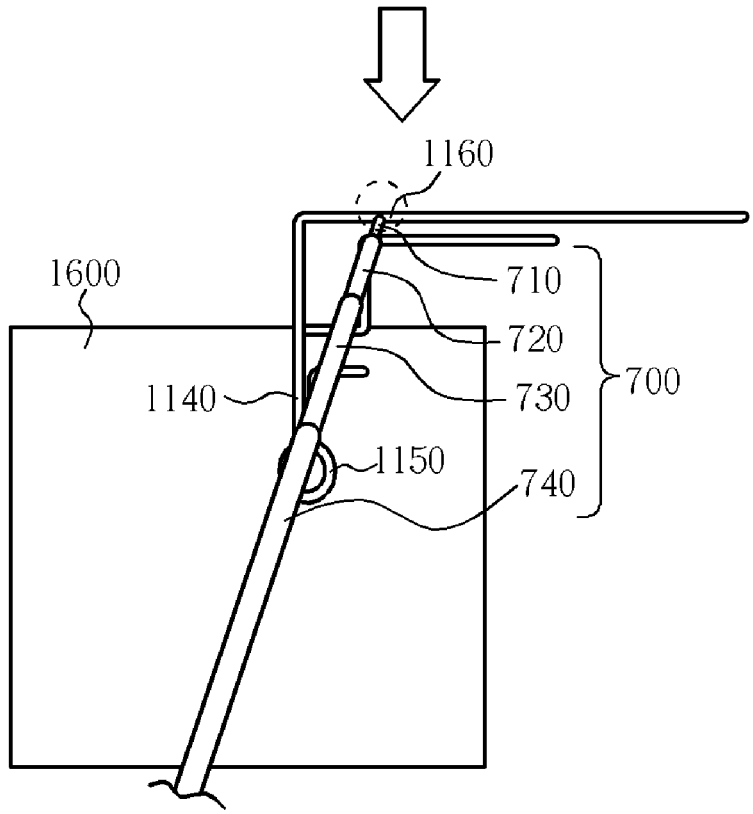

Please refer to FIG. 16. FIG. 16 is a diagram illustrating how to fabricate the antenna structure 1100 shown in FIG. 11, the coaxial cable 700 shown in FIG. 7, and a grounding plane 1600. As shown in 16A, the antenna structure 1100, the coaxial cable 700, the grounding plane 1600, and the elements included are marked respectively. As shown in 16B, the fixing element 1150 of the antenna structure 1100 is fixed on the grounding plane 1600 by locking screws. The feeding point 1160 of the antenna structure 1100 is coupled to the first conductor layer 710 of the coaxial cable 700 in a soldering manner, and the grounding element 1140 is coupled to the second conductor layer 730 of the coaxial cable 700 in a soldering manner as well. By fabricating the antenna structure 1100 and the grounding plane 1600, the grounding effect can be improved.

Figure 17:
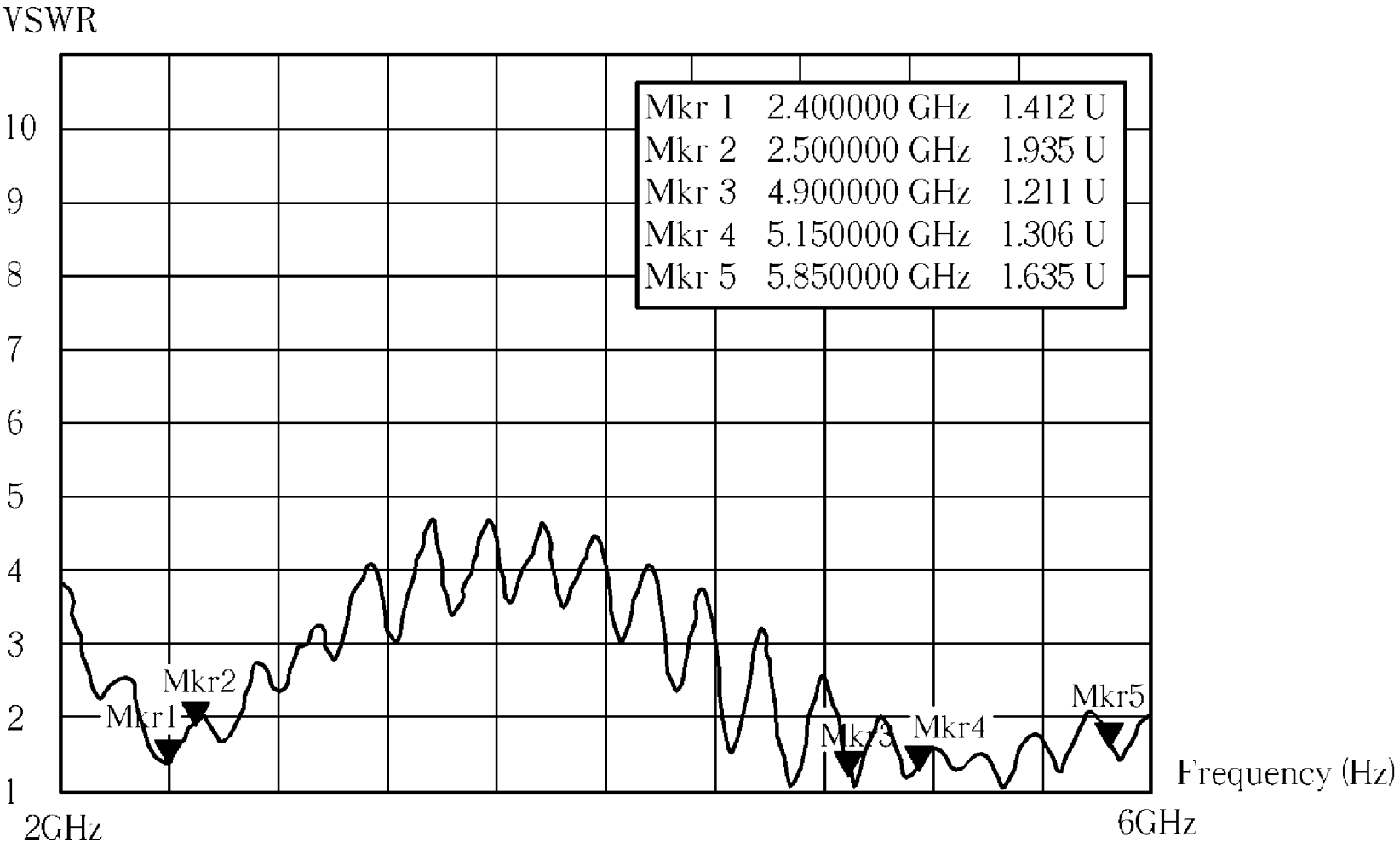
FIG. 17 is a diagram illustrating the VSWR of the antenna structure shown in FIG. 11.

Please refer to FIG. 17. FIG. 17 is a diagram illustrating the VSWR of the antenna structure 1100 shown in FIG. 11. The horizontal axis represents frequency (Hz), between 2 GHz and 6 GGHz, and the vertical axis represents VSWR. As shown in FIG. 17, the frequencies and VSWR of five signs (Mkr 1-Mkr 5) are marked out. The first radiator 1120 of the antenna structure 1100 can resonate at the operating frequency band (2.4 GHz-2.5 GHz) of the first resonance mode, i.e., the signs Mkr 1 and Mkr 2 marked in FIG. 17. Furthermore, the overlapping portion 1115 of the first radiator 1120 and the second radiator 1130 can resonate at the operating frequency band (4.9 GHz-5.85 GHz) of the second resonance mode, i.e., the signs Mkr 3, Mkr 4, and Mkr 5 marked in FIG. 17. As can be seen in FIG. 17, for frequencies adjacent to 2.4 GHz-2.5 GHz, or 4.9 GHz-5.85 GHz, the VSWR all fall below 3, which can satisfy demands of the wireless communication system.

Figure 18:
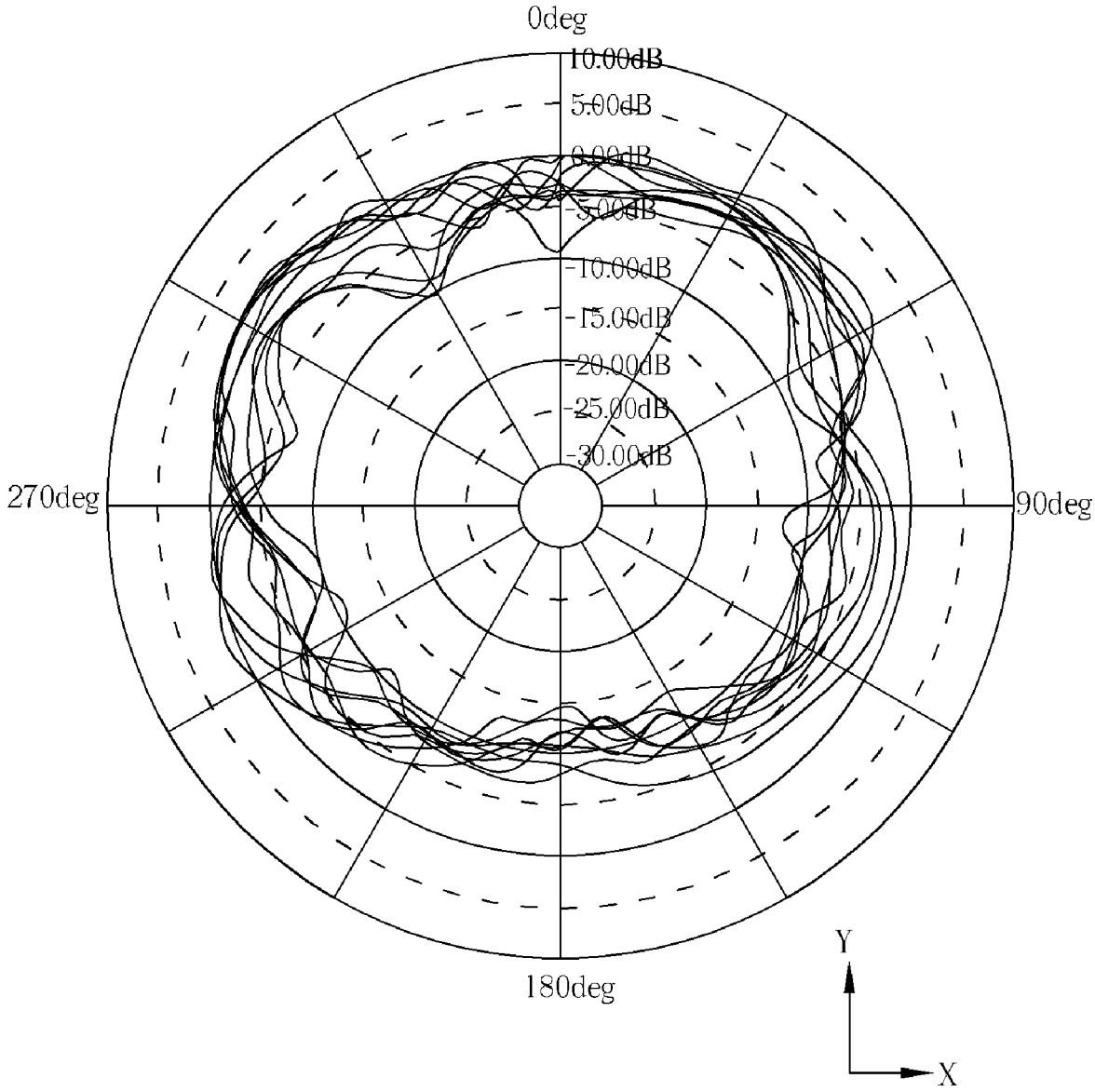
FIG. 18 is a diagram of a radiation pattern of the antenna structure shown in FIG. 11.

Please refer to FIG. 18. FIG. 18 is a diagram of a radiation pattern of the antenna structure 1100 shown in FIG. 11. As shown in FIG. 18, which shows measurement results of the antenna structure 1100 in XY plane, the radiation pattern of the antenna structure 1100 is an omni-directional antenna.

The abovementioned embodiments are presented merely for describing the present invention, and in no way should be considered to be limitations of the scope of the present invention. The radiation element, the grounding element, the feeding point, the fixing element, and the connection element are constructed by metal wire, such as a copper wire. The type of metal wire should not be a limitation of the present invention: the fixing element 150 or 1150 can be a square or a circle, but this should not be a limitation as it can be a polygon or other shapes. Besides, the fixing element 150 or 1150 is an optional element. Those skilled in the art should appreciate that various modifications of shapes and angles of the connection element may be made. Of course, the antenna structures mentioned in the present invention are merely presented for illustrating features of the present invention. Those skilled in the art should appreciate that various modifications of the antenna structures may be made, and the varied embodiments it included should also belong to the scope of the present invention. Furthermore, the antenna structure disclosed in the present invention is a dual-band antenna and is disposed inside a housing of a wireless communication apparatus, such as a portable device or a UMPC, but is not limited to this only and can be applied to wireless communication apparatuses of other types. Be noted that again, if the first radiator and the second radiator are not close to each other and extend in different directions (i.e., FIG. 1), the length of the first radiator 120 is used for resonating the first resonance mode and the length of the second radiator 130 is used for resonating the second resonance mode. If the first radiator and the second radiator are close to each other and extend in the same direction (i.e., FIG. 11), the length of the first radiator 1120 is used for resonating the first resonance mode and the overlapping portion 1115 of the first radiator 1120 and the second radiator 1130 is used for resonating the second resonance mode together.

From the above descriptions, the present invention provides an antenna structure, which utilizes a metal wire to compose each element of the antenna structure. Therefore, not only can cost be lowered but the manufacturing procedure is also simpler, which is conducive to mass production. In addition, as is known from the VSWR and the radiation pattern of the antenna structure disclosed in the present invention, the present invention has advantages such as providing an omni-directional radiation pattern, reducing the size of the antennas, and containing multiple frequency bands of wireless communication systems. Consequently, the antenna structure disclosed in the present invention is suitable for application in a portable device, a UMPC, or in wireless communication apparatuses of other types.

Those skilled in the art will readily observe that numerous modifications and alterations of the device and method may be made while retaining the teachings of the invention.

What is claimed is:

1. An antenna structure, comprising:

a radiation element, comprising:

a first radiator, having a first end; and a second radiator, having a first end close to the first end of the first radiator;

a grounding element, coupled to the first end of the second radiator;

a feeding point, coupled to the first end of the first radiator and close to the first end of the second radiator;

a fixing element, coupled to the grounding element, the fixing element having a hole for fixing the antenna structure on a substrate; and a connection element, coupled between the feeding point and the grounding element, wherein the radiation element, the grounding element, the fixing element, the feeding point, and the connection element are constructed by metal wire.

2. The antenna structure of claim 1, wherein the first radiator and the second radiator extend in different directions.

3. The antenna structure of claim 2, wherein a length of the first radiator is approximately one-fourth of a wavelength of a first resonance mode generated by the antenna structure; and a length of the second radiator is approximately one-fourth of a wavelength of a second resonance mode generated by the antenna structure.

4. The antenna structure of claim 1, wherein the first radiator and the second radiator extend in an identical direction.

5. The antenna structure of claim 4, wherein a length of the first radiator is approximately one-fourth of a wavelength of a first resonance mode generated by the antenna structure; and an overlapping portion of the first radiator and the second radiator is used for resonating a second resonance mode of the antenna structure.

6. The antenna structure of claim 1, further comprising:

a coaxial cable, having a first conductor layer, a first isolation layer, a second conductor layer, and a second isolation layer, wherein the first isolation layer covers the first conductor layer and lies between the first conductor layer and the second conductor layer, the second isolation layer covers the second conductor layer, the first conductor layer is coupled to the feeding point of the antenna structure, and the second conductor layer is coupled to the grounding element of the antenna structure.

7. The antenna structure of claim 1, further comprising:

a first electric wire, coupled to the feeding point of the antenna structure; and a second electric wire, coupled to the grounding element of the antenna structure.

8. An antenna structure formed by bending an identical metal wire, comprising:

a radiation element, comprising:

a first radiator, located at one end of the metal wire; and a second radiator, located at another end of the metal wire;

a connection element, coupled to the first radiator;

a grounding element, coupled to the second radiator; and a feeding point, coupled between the first radiator and the connection element, wherein the radiation element, the connection element, the grounding element, and the feeding point are on the same plane.

9. The antenna structure of claim 8, wherein the first radiator and the second radiator extend in different directions.

10. The antenna structure of claim 9, wherein a length of the first radiator is approximately one-fourth of a wavelength of a first resonance mode generated by the antenna structure; and a length of the second radiator is approximately one-fourth of a wavelength of a second resonance mode generated by the antenna structure.

11. The antenna structure of claim 8, wherein the first radiator and the second radiator extend in an identical direction.

12. The antenna structure of claim 11, wherein a length of the first radiator is approximately one-fourth of a wavelength of a first resonance mode generated by the antenna structure; and an overlapping portion of the first radiator and the second radiator is used for resonating a second resonance mode of the antenna structure.

13. The antenna structure of claim 8, further comprising:

a coaxial cable, having a first conductor layer, a first isolation layer, a second conductor layer, and a second isolation layer, wherein the first isolation layer covers the first conductor layer and lies in between the first conductor layer and the second conductor layer, the second isolation layer covers the second conductor layer, the first conductor layer is coupled to the feeding point of the antenna structure, and the second conductor layer is coupled to the grounding element of the antenna structure.

14. The antenna structure of claim 8, further comprising:

a first electric wire, coupled to the feeding point of the antenna structure; and a second electric wire, coupled to the grounding element of the antenna structure.

15. An antenna structure, comprising:

a radiation element, comprising a first radiator and a second radiator;

a connection element, coupled to the first radiator;

a grounding element, coupled to the second radiator;

a feeding point, coupled between the first radiator and the connection element, wherein the radiation element, the connection element, the grounding element, and the feeding point are constructed by metal wire;

a fixing element, coupled to the grounding element, the fixing element having a hole for fixing the antenna structure on a substrate; and a coaxial cable, having a first conductor layer and a second conductor layer, wherein the first conductor layer is coupled to the feeding point and the second conductor layer is coupled to the grounding element.

16. The antenna structure of claim 15, wherein the first radiator and the second radiator extend in different directions.

17. The antenna structure of claim 16, wherein a length of the first radiator is approximately one-fourth of a wavelength of a first resonance mode generated by the antenna structure; and a length of the second radiator is approximately one-fourth of a wavelength of a second resonance mode generated by the antenna structure.

18. The antenna structure of claim 15, wherein the first radiator and the second radiator extend in an identical direction.

19. The antenna structure of claim 18, wherein a length of the first radiator is approximately one-fourth of a wavelength of a first resonance mode generated by the antenna structure; and an overlapping portion of the first radiator and the second radiator is used for resonating a second resonance mode of the antenna structure.

20. An antenna structure, comprising:

a radiation element, comprising:

a first radiator, having a first end; and a second radiator, having a first end close to the first end of the first radiator, wherein the first end of the second radiator is not directly coupled to the first end of the first radiator, such that there is a gap formed between the first end of the second radiator and the first end of the first radiator;

a grounding element, coupled to the first end of the second radiator;

a feeding point, coupled to the first end of the first radiator and close to the first end of the second radiator; and a connection element, coupled between the feeding point and the grounding element, wherein the radiation element, the grounding element, the feeding point, and the connection element are constructed by metal wire.

* * * * *